US009528355B2

(12) United States Patent
McCrickard et al.

(10) Patent No.: US 9,528,355 B2
(45) Date of Patent: Dec. 27, 2016

(54) ENHANCED OIL PRODUCTION USING CONTROL OF WELL CASING GAS PRESSURE

(71) Applicant: Unico, Inc., Franksville, WI (US)

(72) Inventors: James P. McCrickard, Racine, WI (US); Ronald G. Peterson, Racine, WI (US); Thomas L. Beck, Union Grove, WI (US); Michael D. Dry, Racine, WI (US); Theresa Smigura, Winthrop Harbor, IL (US)

(73) Assignee: Unico, Inc., Franksville, WI (US)

( * ) Notice: Subject to any disclaimer, the term of this patent is extended or adjusted under 35 U.S.C. 154(b) by 410 days.

(21) Appl. No.: 13/923,452

(22) Filed: Jun. 21, 2013

(65) Prior Publication Data

US 2014/0262238 A1 Sep. 18, 2014

Related U.S. Application Data

(60) Provisional application No. 61/783,423, filed on Mar. 14, 2013.

(51) Int. Cl.
*E21B 43/12* (2006.01)

(52) U.S. Cl.
CPC ..... *E21B 43/12* (2013.01)

(58) Field of Classification Search
CPC ..... E21B 43/00; E21B 43/16; E21B 43/25; E21B 43/12; E21B 43/121–43/123; E21B 43/128
See application file for complete search history.

(56) References Cited

U.S. PATENT DOCUMENTS

| | | | | |
|---|---|---|---|---|
| 5,400,858 | A | 3/1995 | Blanchard et al. | |
| 5,634,522 | A * | 6/1997 | Hershberger | 166/372 |
| 6,089,322 | A | 7/2000 | Kelley et al. | |
| 6,119,781 | A * | 9/2000 | Lemetayer et al. | 166/369 |
| 6,298,918 | B1 | 10/2001 | Franco et al. | |
| 6,446,014 | B1 | 9/2002 | Ocondi | |
| 6,497,287 | B1 | 12/2002 | Podio et al. | |
| 6,702,028 | B1 | 3/2004 | Heggholmen | |
| 6,705,397 | B2 * | 3/2004 | Hershberger | 166/250.03 |
| 2002/0074127 | A1 * | 6/2002 | Birckhead et al. | 166/372 |
| 2007/0144738 | A1 | 6/2007 | Sugiyama et al. | |
| 2008/0067116 | A1 | 3/2008 | Anderson et al. | |

FOREIGN PATENT DOCUMENTS

WO 02/36936 A1 5/2002

* cited by examiner

*Primary Examiner* — David Bagnell
*Assistant Examiner* — Ronald Runyan
(74) *Attorney, Agent, or Firm* — Reinhart Boerner Van Deuren P.C.

(57) ABSTRACT

There is provided a system for producing oil from a well bore extending through a fossil fuel reservoir. The system includes a plurality of perforations defined in the casing proximate the fossil fuel reservoir. A gas flow tube is in communication with the annulus volume of the casing proximate the wellhead. A gas valve is coupled to the gas flow tube, with the gas valve configured to selectively open and close the gas flow tube. A controller, is coupled to the gas valve, with the controller configured to control the opening and closing of the gas valve. The opening and closing of the gas valve maximizes the volumetric rate of oil flow into the annulus volume through the perforations from the reservoir by displacing liquid in the annulus volume with a gas volume between the gas valve and the perforations.

6 Claims, 3 Drawing Sheets

ENHANCED OIL PRODUCTION USING CONTROL OF WELL CASING GAS PRESSURE

CROSS-REFERENCE TO RELATED PATENT APPLICATIONS

This patent application claims priority to U.S. Provisional Application No. 61/783,423, filed Mar. 14, 2013, incorporated herein in its entirety, by this reference.

FIELD OF THE INVENTION

This disclosure relates to fossil fuel pumping systems, and more particularly to enhanced oil production using control of well casing gas pressure.

BACKGROUND OF THE INVENTION

In fossil fuel pumping systems, the fossil fuel, from a fossil fuel reservoir typically is under pressure because of, among other things, the overburden material. The flow from the fossil fuel reservoir to a well bore is based on the reservoir pressure being greater than the well flowing pressure. The greater the difference between the reservoir pressure and the well flowing pressure the greater the flow will be from the fossil fuel reservoir into the well bore, typically the casing of the well bore.

For a typical well, a plurality of perforations exists in the well bore casing such that the fluid from the fossil fuel reservoir flows through the perforations into the well bore casing. When the fluid entering the well casing forms a liquid column above the perforation, the in-flow rate of the fluid is decreased. It is known in the art that increasing pumping rates can lower the fluid level in the well casing to be below the perforations thereby allowing an increase in flow.

The apparatus of the present disclosure must be of construction which is both durable and long lasting, and it should also require little or no maintenance to be provided by the user throughout its operating lifetime. In order to enhance the market appeal of the apparatus of the present disclosure, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

The disadvantages and limitations of the background art discussed above are overcome by the present disclosure.

There is provided a system for producing oil from a well bore extending through a fossil fuel reservoir. The well bore includes a casing defining an annulus volume, a production tube disposed in the casing with the production tube coupled at one end to a wellhead and another end coupled to a pump. The pump is configured to move liquid from the casing to the wellhead.

The system includes a plurality of perforations defined in the casing proximate the fossil fuel reservoir. A gas flow tube is in communication with the annulus volume of the casing proximate the wellhead. A gas valve is coupled to the gas flow tube, with the gas valve configured to selectively open and close the gas flow tube.

A controller, is coupled to the gas valve, with the controller configured to control the opening and closing of the gas valve. The opening and closing of the gas valve maximizes the volumetric rate of oil flow into the annulus volume through the perforations from the reservoir by displacing liquid in the annulus volume with a gas volume between the gas valve and the perforations.

In one embodiment, the controller includes a computer, a database with pump fill set points established by the user of the system.

In one embodiment the controller is configured to monitor the pump speed over time and either increase or decrease pressure in the casing by a predetermined amount relative to pump fill operation.

The apparatus of the present disclosure is of a construction which is both durable and long lasting, and which will require little or no maintenance to be provided by the user throughout its operating lifetime. Finally, all of the aforesaid advantages and objectives are achieved without incurring any substantial relative disadvantage.

DESCRIPTION OF THE DRAWINGS

These and other advantages of the present disclosure are best understood with reference to the drawings, in which.

DETAILED DESCRIPTION OF THE EXEMPLARY EMBODIMENTS

Figure 1:
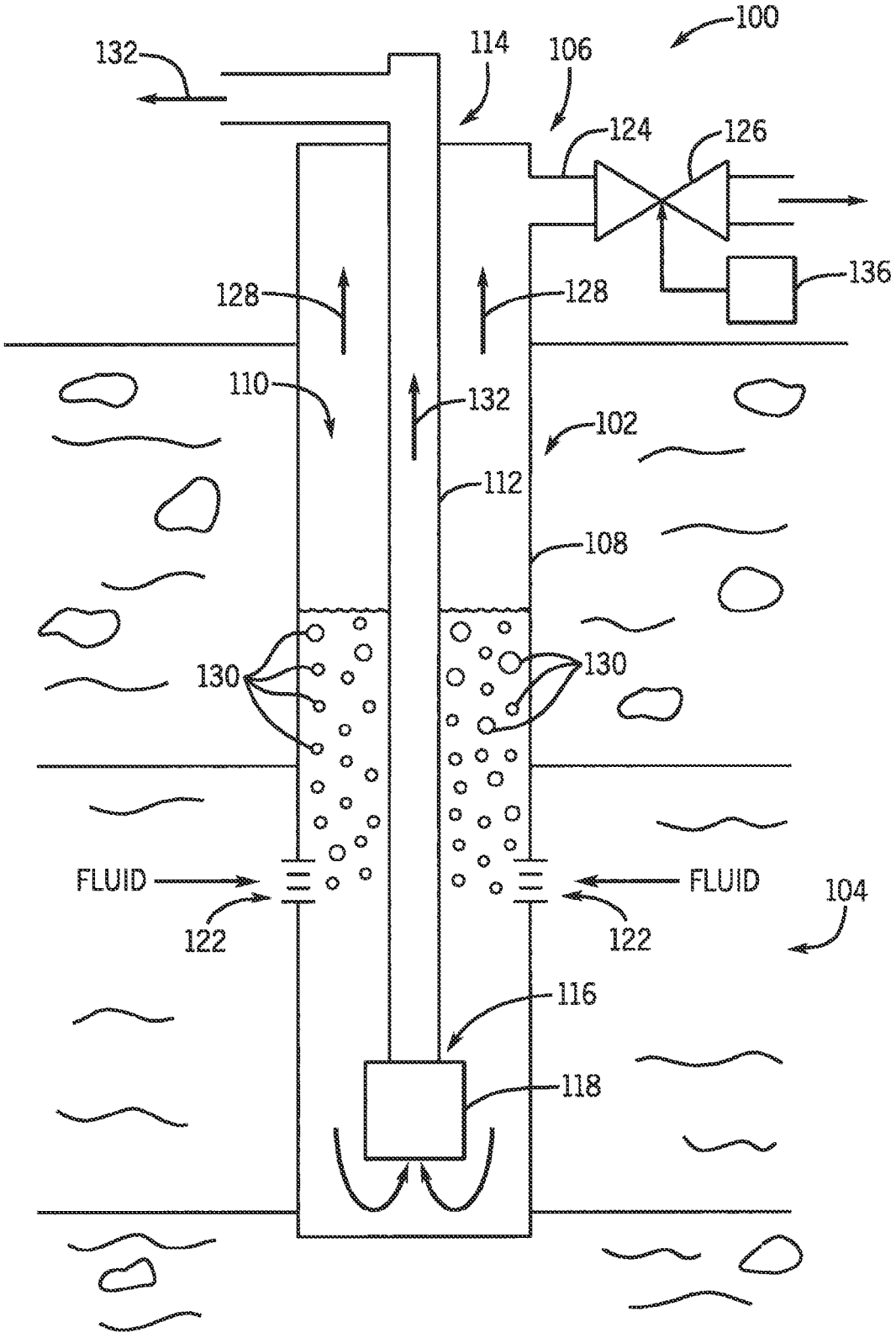
FIG. 1 is a schematic illustration of a system for producing oil from a well bore extending through a fossil fuel reservoir with the well casing defining a plurality of perforations in communication with an annulus volume of the well casing and the fossil fuel.
Figure 2:
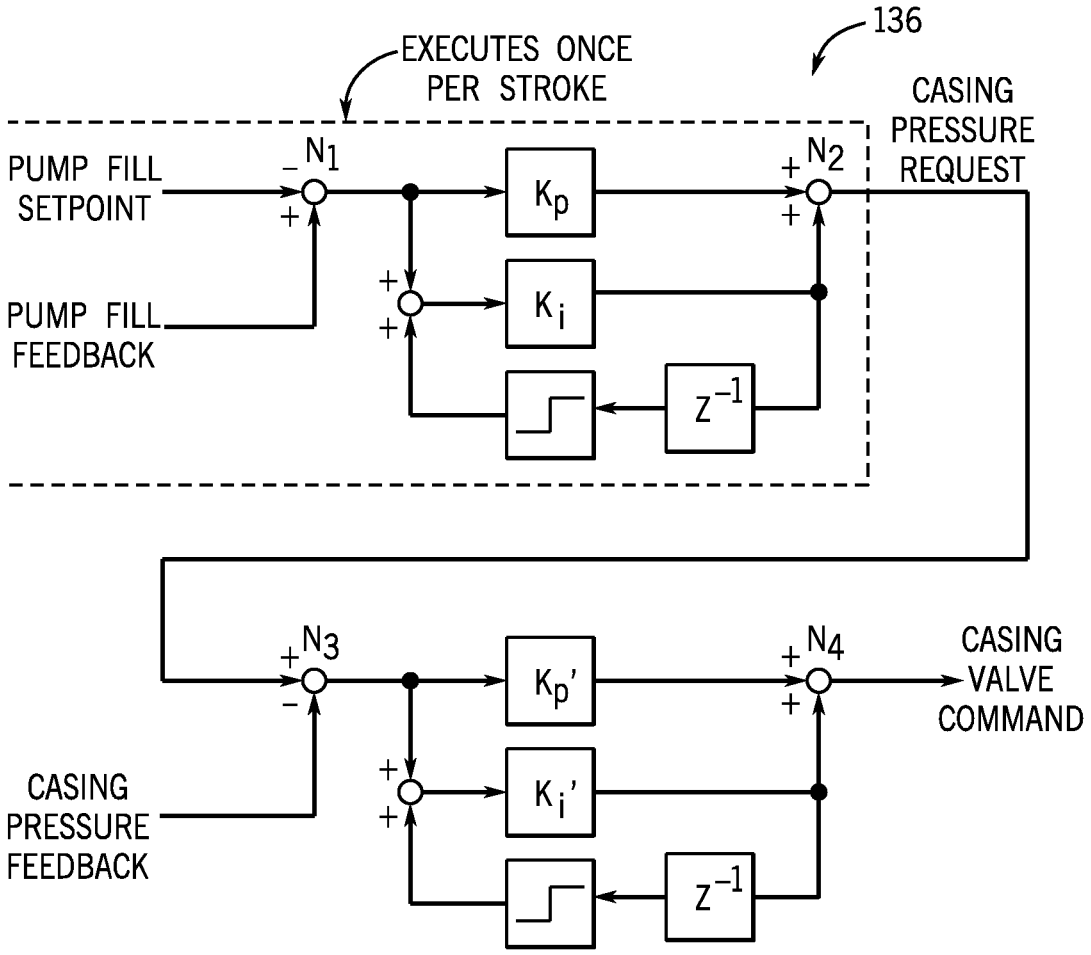
FIG. 2 is a schematic diagram of a controller configured for controlling the downhole pump by controlling gas pressure in the annulus volume illustrated in FIG. 1.
Figure 3:
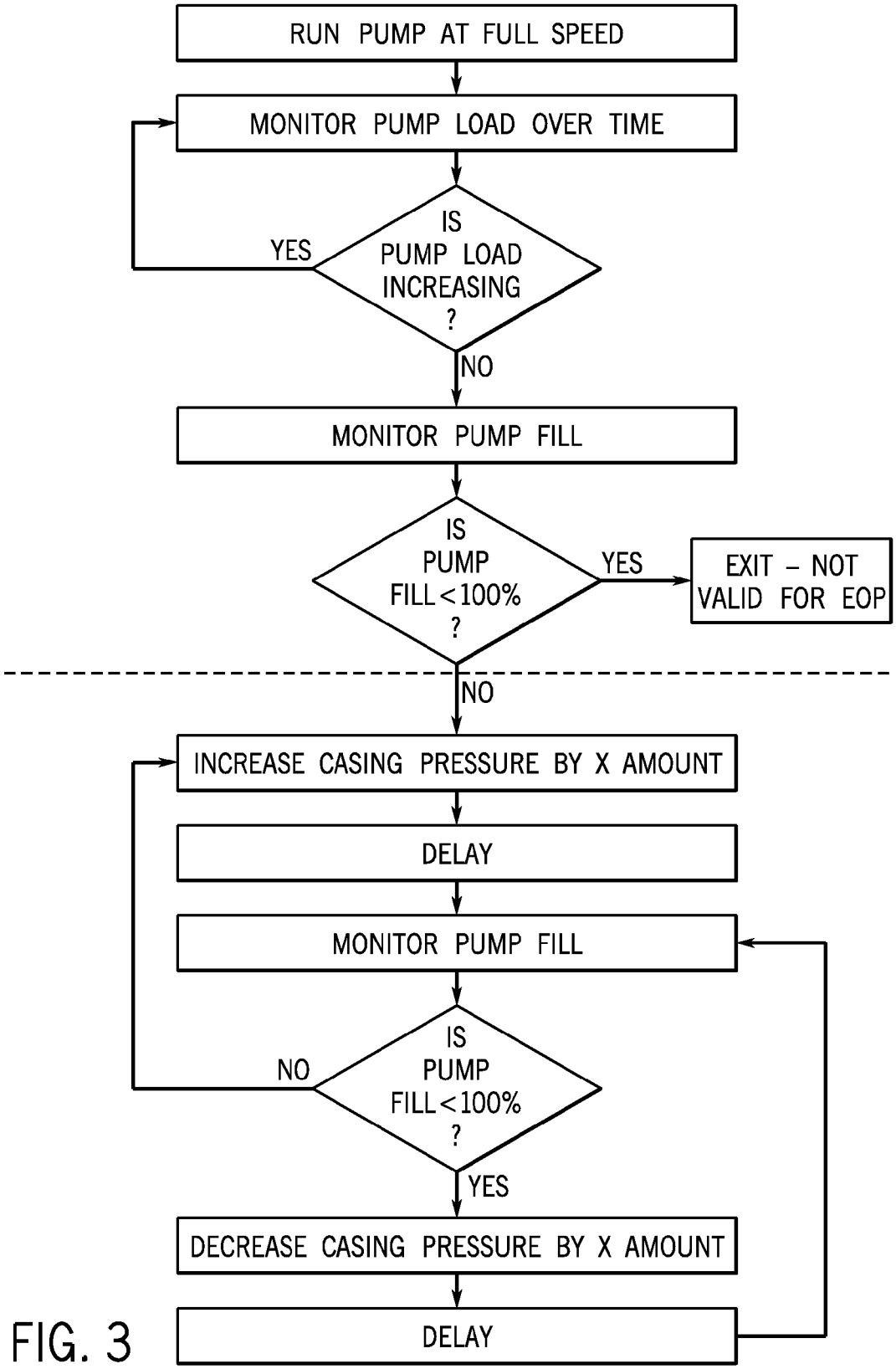
FIG. 3 is a flow chart of a sequence of steps occurring with the controller illustrated in FIG. 2 to facilitate operation of the downhole pump of the system illustrated in FIG. 2.

Referring to the FIGS. 1-3, FIG. 1 illustrates an oil well that is producing oil by artificial lift under pseudo-steady state conditions. Fluid enters the casing of the well bore 102 from the fossil fuel reservoir through a plurality of perforations 120. The fluid is typically a mixture containing water and free gas in addition to oil. The free gas 130 that enters the well bore 102 moves up to the surface between the production tubing 112 and the casing 108 of the well bore 102 to the gas flow line 124 at the surface. The oil and water enter the pump 118, which lifts the liquid mixture 132 through the production tubing 112 to the liquid flow line 134 at the surface.

Fluid is driven to the well bore 102 by the average pressure difference between the reservoir 104 and the well bore 102 at the perforations 122. The volumetric rate, Q, at which liquid enters the well bore 102 under pseudo-steady state conditions depends on the average pressure of the fluid in the reservoir 104 $P_r$, being drained by the system 100 and the well flowing pressure, $P_{wf}$, which is the pressure in the well bore 102 at the perforations 122. The inflow rate also depends on a variety of other factors such as the permeability of the reservoir rock, the viscosity of the fluids, the saturations of the fluids, the height of the perforations, the well bore radius and the drainage area.

For example, if the reservoir pressure and the well flowing pressure are both above the bubble point pressure of the oil then the liquid inflow rate under pseudo-steady state conditions is approximately related to the reservoir pressure and the well flowing pressure by the following simple equation:

$$Q=J(P_r-P_{wf}).$$

J is referred to as the productivity index and depends on the list of factors described in the preceding two paragraphs. For pressures equal to or less than the bubble point pressure, gas that is dissolved in the oil evolves from the oil and becomes free gas 130. There are other relatively simple equations that approximately describe the relationship between the liquid inflow rate, and the reservoir pressure and the well flowing pressure, when the well flowing pressure is below the bubble point or when both pressures are below the bubble point. All of these equations predict that the pseudo-steady inflow rate increases as the well flowing pressure decreases. The maximum inflow rate, $Q_{max}$, occurs when the well flowing pressure is as low as possible, that is, when the well flowing pressure is equal to atmospheric pressure.

Under steady state production conditions the volumetric rate at which the pump 118 removes liquid from the well bore 102 is equal to the rate at which liquid enters the well bore 102. The well flowing pressure is determined indirectly by the volumetric rate at which the pumping unit 118 removes fluid from the well bore 102. If the pump 118 removes liquid from the well bore 102 at a rate that is less than the maximum inflow rate, then there will be a volume of liquid above the perforations 122 in the annular space 110 between the production tubing 112 and the casing 108. The lower the volumetric rate of the pump, the greater the height of this liquid column. This liquid column develops during an initial transient period before the system settles into pseudo-steady state production. It is the height of this liquid column that largely determines the well flowing pressure. If the liquid column extends above the perforations, thereby covering the perforations, less liquid from the reservoir will flow into the well bore 102. The following equation describes the relationship between the height, h, of the liquid column above the perforations 122 and the well flowing pressure, $P_{wf}$.

$$P_{wf}=\rho_l gh+\rho_g g(L-h)+P_c \quad (1)$$

In this equation $\rho_l$ is the mean density of the liquid in the column, $\rho_g$ is the mean density of the gas in the casing annulus 110 above the liquid column, $P_c$ is the casing gas pressure at the surface, L is the depth of the perforations below the surface and g is the acceleration due to gravity.

There are many reasons why an oil well might be pumped at a rate that is less than the maximum inflow rate, with a corresponding well flowing pressure equal to atmospheric pressure. For example, for a reservoir for which the reservoir pressure is above the bubble point, it is advisable to set the well flowing pressure no lower than the bubble point to prevent damage to the reservoir associated with the evolution of free gas in the reservoir. As another example, if a reservoir has an aquifer underlying the oil then setting the well flowing pressure too low will cause water to cone into the well from the aquifer and adversely affect the ultimate oil recovery from the reservoir. As a third example, if a reservoir has a gas cap that overlays the oil then producing the well with too low a well flowing pressure will cause gas coning into the well bore which again adversely effects the ultimate recovery of oil from the reservoir. In all of these cases, and others not listed here, the pumping rate is less than the maximum inflow rate and the well flowing pressure is greater than atmospheric pressure. As a consequence, there will typically be a volume of liquid in the casing annulus above the perforations in cases where the pumping rate is less than the maximum inflow rate. This liquid column in the casing annulus is depicted in FIG. 1. The free gas that enters the well bore bubbles up through the liquid column to the gas flow line 124 at the surface as shown in the drawing.

It has been determined that oil production can be enhanced by replacing the liquid column in the casing annulus with a gas column that produces the same well flowing pressure. The oil production is greater with exactly the same well flowing pressure when the outer walls of the wellbore at the perforations are exposed to gas rather than liquid. The present disclosure describes a control system for achieving this end. The basic idea is that it is possible to control the value of $P_c$ in equation (1) using a valve in the gas flow line at the surface, while keeping $P_{wf}$ constant, so that h=0.

A system 100 for enhanced oil production, typically producing oil from a well bore 102, uses casing gas pressure to control the fluid level in the well bore 102. The well bore 102 extends through a fossil fuel reservoir 104. The well bore 102 includes a casing 108 that defines an annulus volume 110. The casing 108 typically is a series of pipes extending into the well bore, through and typically beyond the fossil fuel reservoir 104. A production tube 112, also a series of pipes, is disposed in the casing 108 with the production tube 112 coupled at one end 114 to a well head 106 and another end 116 coupled to a pump 118. The pump 118 is configured to move liquid 132 from the casing 108 to the well head 106.

The production tube 112 is coupled to the well head 106 and coupled to other equipment for further processing. The casing 108 of the well bore 102 is coupled to a gas flow tube 124. A gas valve 126 is coupled to the gas flow tube 124 with the gas valve 126 controlled by a controller 136. The controller 136 typically includes a computer, computer readable media, and a database. The controller 136 typically also includes mechanisms, for example, a relay, an electronic switch, an actuator, coupled to the control gas valve 126 for opening and closing the valve as required or determined by a user of the system 100.

The casing 108 defines a plurality of perforations 122. A perforation 120 is in fluid communication with the fossil fuel reservoir 104 and the annulus volume 110 of the well bore 102. The arrangement of the plurality of perforations 122 are determined by a user of the system 100 and typically includes the number of perforations 120, the dimensions of the perforations and the physical positioning of the plurality of perforations 122 as determined by the user of the system 100.

A gas flow tube 124 is in communication with the annulus volume 110 of the casing 108, typically proximate the well head 106.

The controller 136 is coupled to the gas valve 126 with the controller 136 configured to control the opening and closing of the gas valve 126 to control the volumetric rate of oil flow into the annulus volume 110. The two embodiments of control configured in the controller 136 are illustrated in FIGS. 2 and 3 and more fully described below. The flow of liquid 132 into the annulus volume 110 is through the plurality of perforations 122 from the fossil fuel reservoir 104. The gas volume 128 which percolates, or bubbles, from the liquid 132 in the annulus volume 110 is used to displace the liquid in the annulus volume 110 above the plurality of perforations 122. The gas volume 128 is the volume between the gas valve 126 and the perforations 122. The gas volume 128 is used to control the value of the casing gas pressure $P_c$ to keep the well flowing pressure $P_{wf}$ constant while reducing the height of the liquid column h in the casing 108.

Referring to FIGS. 2 and 3, FIG. 2 illustrates an exemplary embodiment of control in the system 100 to control the downhole pump fill volume. A pump fill set point is established in the controller 136 database and is subtracted from the pump fill feedback at node $N_1$. The resulting difference is input to a proportional-integral (PI) controller which outputs a casing pressure request at node $N_2$. The portion of the controller within the dotted lines is executed once per stroke of the pumping system.

The casing pressure feedback is subtracted from the casing pressure request at node $N_3$. The resulting difference is input to a PI controller which outputs a casing valve command at node $N_4$. If the pump fill feedback is less than the pump fill setpoint, the controller will decrease the casing pressure by further opening the gas valve 126 at node $N_4$ and continue to monitor pump fill relative to the pump fill set point as originally established in the system 100. If the pump fill feedback is more than the pump fill setpoint, the controller will increase the casing pressure by further closing the gas valve 126 at node $N_4$ and continue to monitor pump fill relative to the pump fill set point as originally established in the system 100.

FIG. 3 illustrates another exemplary embodiment of control in the system 100 to control the down hole pump fill volume. The pump 118 is run at full speed with the pump load monitored over time. If the pump loading is increasing the pump load will continue to be monitored as shown in FIG. 3. If the pump load is not increasing, the pump fill will be monitored. If the pump fill is 100% without increasing the casing pressure, the casing pressure will be incrementally increased by a set amount until the pump fill drops below 100% and then incrementally decreased and increased as shown to keep the pump fill at or just below 100%. The controller will increase or decrease the casing pressure by a predetermined amount (X) in relation to the pump fill operation described above. For purposes of this application, the phrase "just below" means as close to 100% as practicable within the specifications of the equipment being used in a specific configuration determined by a user of the equipment.

The controller 136 controls the opening and closing of the gas valve 126, which in turn controls the volumetric rate of oil flow into the annulus volume 110 which is maximized through the perforations 122 from the reservoir 104. The gas volume 128 displaces the liquid 132 in the annulus volume 110 so that the gas volume extends over the perforations 122 rather than liquid 132 in the annulus volume 110 of the well casing 108.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of the present mechanism has been shown and described with reference to particular embodiments and applications thereof, it has been presented for purposes of illustration and description and is not intended to be exhaustive or to limit the disclosure to the particular embodiments and applications disclosed. It will be apparent to those having ordinary skill in the art that a number of changes, modifications, variations, or alterations to the mechanism as described herein may be made, none of which depart from the spirit or scope of the present disclosure. The particular embodiments and applications were chosen and described to provide the best illustration of the principles of the mechanism and its practical application to thereby enable one of ordinary skill in the art to utilize the disclosure in various embodiments and with various modifications as are suited to the particular use contemplated. All such changes, modifications, variations, and alterations should therefore be seen as being within the scope of the present disclosure as determined by the appended claims when interpreted in accordance with the breadth to which they are fairly, legally, and equitably entitled.

What is claimed is:

1. A system for producing oil from a well bore extending through a fossil fuel reservoir, the well bore including a casing defining an annulus volume, a production tube disposed in the casing with the production tube coupled at one end to a wellhead and another end coupled to a pump configured to move liquid from the casing to the wellhead, the system comprising:

a plurality of perforations defined in the casing proximate the fossil fuel reservoir, the pump being disposed in the well bore below the casing;

a gas flow tube in communication with the annulus volume of the casing proximate the wellhead;

a gas valve coupled to the gas flow tube, the gas valve configured to selectively open and close the gas flow tube; and a controller coupled to the gas valve, the controller configured to control the opening and closing of the gas valve to maximize the volumetric rate of oil flow into the annulus volume through the perforations from the reservoir by displacing liquid in the annulus volume covering the perforations with a gas volume between the gas valve and the perforations.

2. The system of claim 1, wherein the gas valve is configured to control a pressure in the casing at the surface of the well bore such that a well flowing pressure is constant.

3. The system of claim 1, further comprising the controller configured with a pump fill set point, wherein the controller is further configured to:

combine the pump fill set point and a pump fill feedback signal value to generate a casing pressure request signal value; and combine the casing pressure request signal value with a casing pressure feedback signal value to generate a casing valve command wherein the volumetric rate of oil flow into the annulus volume is maximized.

4. The system of claim 3, wherein the controller monitors the pump fill once per pump stroke.

5. The system of claim 1, wherein the controller is configured to run the pump at full speed and monitor pump load for a predetermined time, if the pump load is increasing, the controller will continue to monitor the pump load, if the pump load is not increasing, pump fill will be monitored, if the pump fill is 100% without increasing the casing pressure, the casing pressure will be incrementally increased by a set amount by the controller closing the gas valve until the pump fill drops below 100%, the controller cycling incrementally the gas valve to one of decrease and increase the casing pressure to keep the pump fill at or just below 100%, wherein the volumetric rate of oil flow into the annulus volume is maximized.

6. A method for producing oil from a well bore extending through a fossil fuel reservoir, the well bore including a casing defining an annulus volume, a production tube disposed in the casing with the production tube coupled at one end to a wellhead and another end coupled to a pump configured to move liquid from the casing to the wellhead, the method comprising:

defining a plurality of perforations in the casing proximate the fossil fuel reservoir;

coupling a gas flow tube to the annulus volume of the casing proximate the wellhead;

coupling a gas valve to the gas flow tube, with the gas valve configured to selectively open and close the gas flow tube; and coupling a controller to the gas valve, and configuring the controller to control the opening and closing of the gas valve to maximize the volumetric rate of oil flow into the annulus volume through the perforations from the reservoir by displacing liquid in the annulus volume covering the perforations with a gas volume, with the controller configured to monitor the pump fill over time and one of increase and decrease pressure in the casing by a predetermined amount relative to pump fill operation.

* * * * *